US011462196B1

(12) United States Patent
Gruenberg

(10) Patent No.: US 11,462,196 B1
(45) Date of Patent: Oct. 4, 2022

(54) MUSICAL INSTRUMENT SUPPORT

(71) Applicant: Eric Ivor Gruenberg, Las Vegas, NV (US)

(72) Inventor: Eric Ivor Gruenberg, Las Vegas, NV (US)

( * ) Notice: Subject to any disclaimer, the term of this patent is extended or adjusted under 35 U.S.C. 154(b) by 0 days.

(21) Appl. No.: 17/497,114

(22) Filed: Oct. 8, 2021

Related U.S. Application Data

(60) Provisional application No. 63/108,359, filed on Nov. 1, 2020, provisional application No. 63/094,367, filed on Oct. 21, 2020.

(51) Int. Cl.
*G10G 5/00* (2006.01)

(52) U.S. Cl.
CPC ..... *G10G 5/005* (2013.01)

(58) Field of Classification Search
CPC ..... G10G 5/005; G10G 5/00
See application file for complete search history.

(56) References Cited

U.S. PATENT DOCUMENTS

| | | | | |
|---|---|---|---|---|
| 1,945,162 | A | 1/1934 | Rasmussen | |
| 4,966,062 | A | 10/1990 | Driggers et al. | |
| 6,005,175 | A | 12/1999 | Johnson | |
| 7,205,468 | B1 | 4/2007 | Johnson | |
| 8,455,744 | B2 | 6/2013 | Barnett | |
| 8,530,733 | B2 | 9/2013 | Bibb | |
| 9,514,721 | B1 | 12/2016 | Champion | |
| 2003/0217635 | A1* | 11/2003 | Christou | G10G 5/005 84/327 |
| 2013/0305897 | A1 | 11/2013 | Barnett | |

FOREIGN PATENT DOCUMENTS

| | | | |
|---|---|---|---|
| DE | 1895504 | A1 | 3/2008 |
| JP | 2004341462 | A | 12/2004 |
| JP | 2005043844 | A | 2/2005 |
| JP | 2016018019 | A | 1/2015 |

OTHER PUBLICATIONS

Alan Korkmaz, Design for Performability in Nylon Strung Acoustic Guitars, Jun. 2017, pp. 43-66.

* cited by examiner

*Primary Examiner* — Kimberly R Lockett
(74) *Attorney, Agent, or Firm* — James M. Duncan; Scanlon Duncan LLP

(57) ABSTRACT

A musical instrument support has pivoting clamp members, with a first clamp member attached to a base member and a second clamp member attached to a shuttle member, with an adjustable distance between the two clamp members. The first clamp member and the second clamp member pivot independently of each other, thereby allowing attachment to a musical instrument having a variable or uneven body thickness. The musical instrument support may also have a socket attached to the bottom of the member. A support pillar may be attached to the base member, such as by a ball end of the support pillar received within the socket, which allows the angle of the support pillar to be changed with respect to the base member and with respect to the instrument. An opposite end of the support pillar may be attached to a leg support or extend to the floor.

20 Claims, 19 Drawing Sheets

MUSICAL INSTRUMENT SUPPORT

RELATED APPLICATIONS

This application claims domestic priority to Provisional Patent Application No. 63/094,367 filed on Oct. 21, 2020 and Provisional Patent Application No. 63/108,359 filed on Nov. 1, 2020.

BACKGROUND OF THE INVENTION

Musicians, such as classical guitar players, may require elevation of the instrument, in a secure and stable manner, to play with the most proficiency. For classical guitarists, foot stools have traditionally been used for this purpose, where the musician places a foot on the foot stool, thereby raising the knee which is utilized to support the instrument. However, because the raised knee places a player's body in an asymmetric position, continued and prolonged practice and performance in this position can cause back strain and discomfort. This same issue may be present for players of other stringed instruments which are supported with one hand on the neck of the instrument while the other hand is utilized to play the strings of the instruments, the instrument supported by the musician's knee. Such instruments may include, by way of non-exclusive example, steel string guitars, mandolins, ukuleles, etc.

Elevation of the knee can be eliminated if some other mechanism is utilized to raise the instrument to the correct position. For example, an instrument support may be placed between the musician's knee and the instrument to raise the instrument by the desired amount. One such instrument support is a cushion which is placed between the musician's knee and the instrument. However, the cushion is held in place by the weight of the instrument, and any appreciable movement can dislodge the cushion and cause problems for the musician's practice or performance.

Other instrument supports attempt to solve this problem by providing an attachment mechanism which secures the support to the instrument. Because it is usually important that the support be relatively easy to transport and that the support causes no damage to the instrument, the attachment mechanisms for attaching the support to the instrument are typically temporary and configured so that attaching the support to the instrument is relatively easy and fast. However, it is important that the attachment mechanism securely attach the support to the instrument, while also allowing the musician the ability to move with the instrument for comfort, for purposes related to technique, and to allow the musician to perform a particular piece in an expressive manner.

A variety of attachment mechanisms for instrument supports are known, with the most common mechanisms being suction cups, magnets and clamps. However, each of these known mechanisms have drawbacks.

Suction cups can come loose and not all instrument finishes are able to retain a suction. In addition, there is a concern that suction cups may mar a sensitive instrument finish.

Magnetic attachment mechanisms require that magnets be placed on the inside of the instrument and typically retained with adhesive strips. The interior magnets must be placed so as to attract pairing magnets attached to the support, with the magnetic field maintaining the support in the desired position. However, some musical instruments are configured such that gaining access to the interior of the instrument is difficult, some may even have a solid body, therefore having no interior at all, or the interior location most preferable for attachment of the magnets has structural members which interfere with placement of the magnets, making it difficult to maintain a sufficiently strong magnetic field to prevent the support from becoming detached.

Clamps can be a good solution. However, the known clamps can only be used on an instrument having a uniform thickness at the clamp attachment point. Some modern classical guitars have bodies with variable thicknesses. For example, classical guitars with "raised fingerboards" achieve this configuration by decreasing the thickness of the guitar body near the fingerboard. The known clamp supports cannot be used with this type of instrument. Even with guitars having uniform body thickness, variations in the clamp size and the instrument, as well, in the manufacturing process can lead to uneven gripping force when pairs of grippers are deployed.

All of the above-described support mechanisms typically do not allow the musician to move the musical instrument to any great degree because the movement will cause the instrument to come loose from the support. This limitation can inhibit the musician's musical performance, limit various playing techniques employed by the musician, or limit the musician's ability to shift position during a performance out of fear that the support will become detached from the instrument.

SUMMARY OF THE INVENTION

Embodiments of the present invention provide a solution to the problems identified above by utilizing an instrument support member configured to clamp onto instrument bodies having both a uniform thickness or a thickness which varies along the length of the instrument. The instrument support member may have a first instrument clamp member pivotally attached to a base member and a second instrument clamp member pivotally attached to a shuttle member. The first instrument clamp member is configured to pivot independently from the second instrument clamp member and the second instrument clamp member is configured to pivot independently of the first instrument clamp member. The shuttle member is slidingly attached to the base member.

The instrument support member has a shuttle member translation mechanism which translates the shuttle member along a surface of the base member from a first position to a second position. The second instrument clamp member is configured to move towards the first instrument clamp member as the shuttle member is translated to the first position and the second instrument clamp member configured to move away from the first instrument clamp member when the shuttle member is translated to the second position.

Embodiments of the shuttle translation member may comprise an adjustment screw which extends through an aperture in the base member, the adjustment screw having a first end which is retained at the aperture and a second end which is attached to the shuttle member, wherein rotation of the adjustment screw in a first direction translates the shuttle member towards the first position and rotation of the adjustment screw in a second direction translates the shuttle member towards the second position.

Embodiments of the present invention may comprise a cam and lever actuator which is configured to urge the second instrument clamp member toward the first instrument clamp member with a rotation of the lever actuator.

Embodiments of the present invention may comprise a support pillar having a first end attached to the base member. The support pillar may be attached to a socket member attached to the base member, where the first end of the support pillar may have a ball end which is received within the socket member. The socket member may have threads which are configured to receive a retaining cup, wherein the tightening of the retaining cup upon the threads of the socket member restrains a support pillar ball end from movement. Embodiments of the support pillar may have an extension rod which attaches to the support pillar, thereby extending the length of the support pillar. The extension rod may be attached to the support pillar by a collar member disposed between the support pillar and the extension rod. The collar member may be configured to allow rotation between the extension rod and the support pillar, thereby allowing rotation between the instrument support member and the leg support member. This allows a musician to rotate the instrument with respect the musician's body while putting no strain on the clamp or leg rest.

Embodiments of the support pillar may have a second end pivotally attached to a leg support member. The extension rod and the support pillar may be configured into a telescoping unit which is configured to allow a variable length between the instrument support member and the leg support member. Alternatively, the second end of the support pillar may telescope and extend to the floor, thereby allowing a musician to play the instrument in the same position as a cello.

DETAILED DESCRIPTION OF THE EMBODIMENTS

Figure 1:
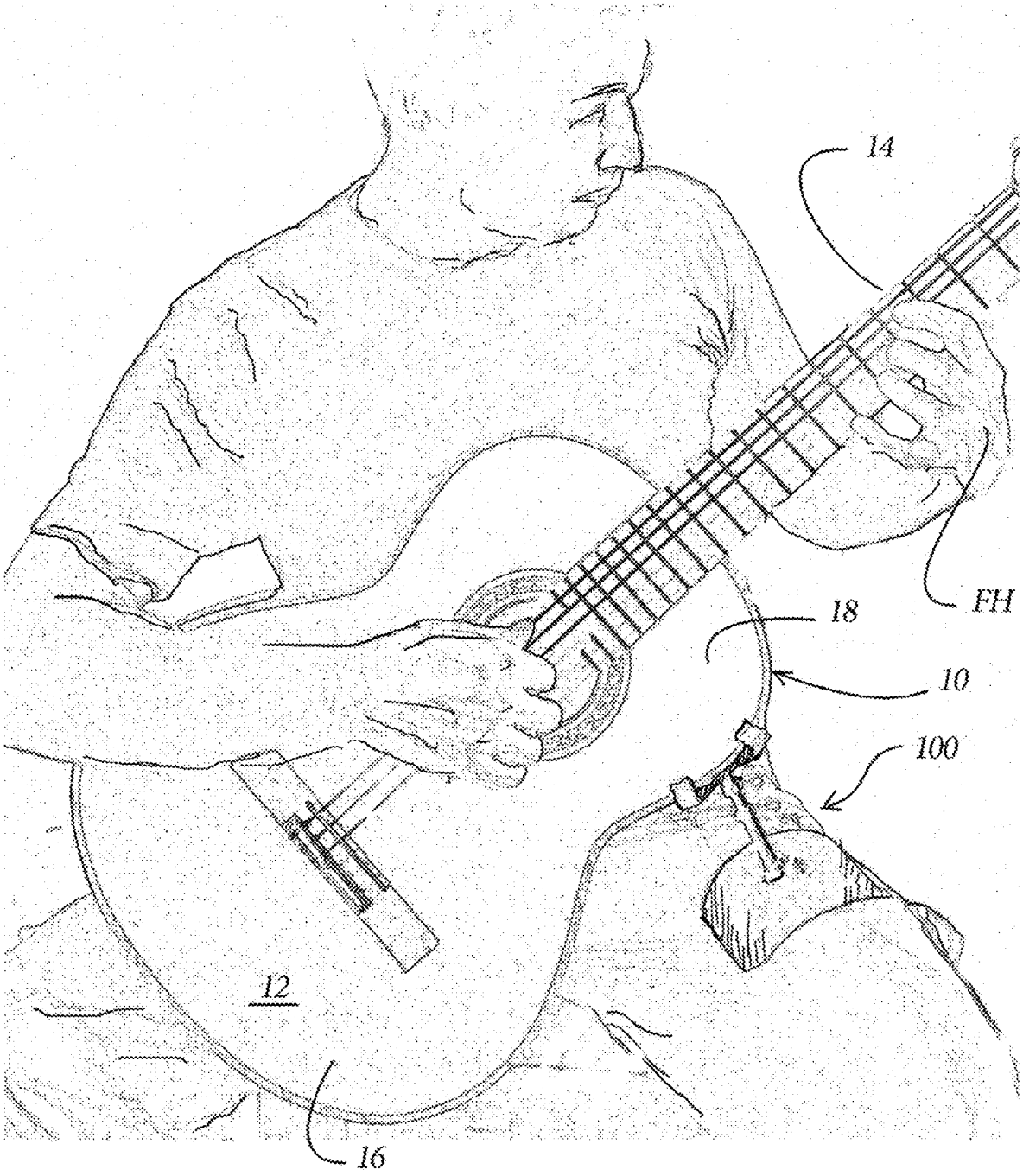
FIG. 1 depicts a musician utilizing an embodiment of the present invention to support a musical instrument.

Referring now to the figures, FIG. 1 depicts a musician playing a stringed musical instrument 10 with an embodiment of the musical instrument support 100. As shown in FIG. 1, the stringed musical instrument 10 is of the type having a body comprising a body 12 having a neck 14 which extends from the body. With this type of stringed instrument, the musician utilizes one hand to activate the strings by picking, plucking, strumming, etc. and the other hand to depress the strings against a fingerboard disposed on the neck 14. This type of stringed musical instrument may include classical guitars (as depicted in the Figures), as well as acoustic guitars, acoustic bass, mandolin, and other instruments.

As shown in FIG. 1, the body 12 is typically supported by the legs of the musician while the neck is supported by one of the musician's hands. For musical instruments 10, such as guitars, the body 12 of the instrument may be configured to have a lower bout section 16 and an upper bout section 18. In one playing position, such as that depicted in FIG. 1, the lower bout section 16 is supported between the musician's legs. The upper bout may be supported directly by one of the musician's legs, resting in direct contact with the leg. However, when the upper bout section 18 is directly supported by the leg, obtaining a playing posture which allows the most efficient use of the musicians fretting hand FH requires the raising of the musician's leg. As discussed above, this raised leg position places the musician's body in an asymmetrical position which can result in fatigue, discomfort, and ultimately cause or aggravate injuries to the musician's back.

Figure 2:
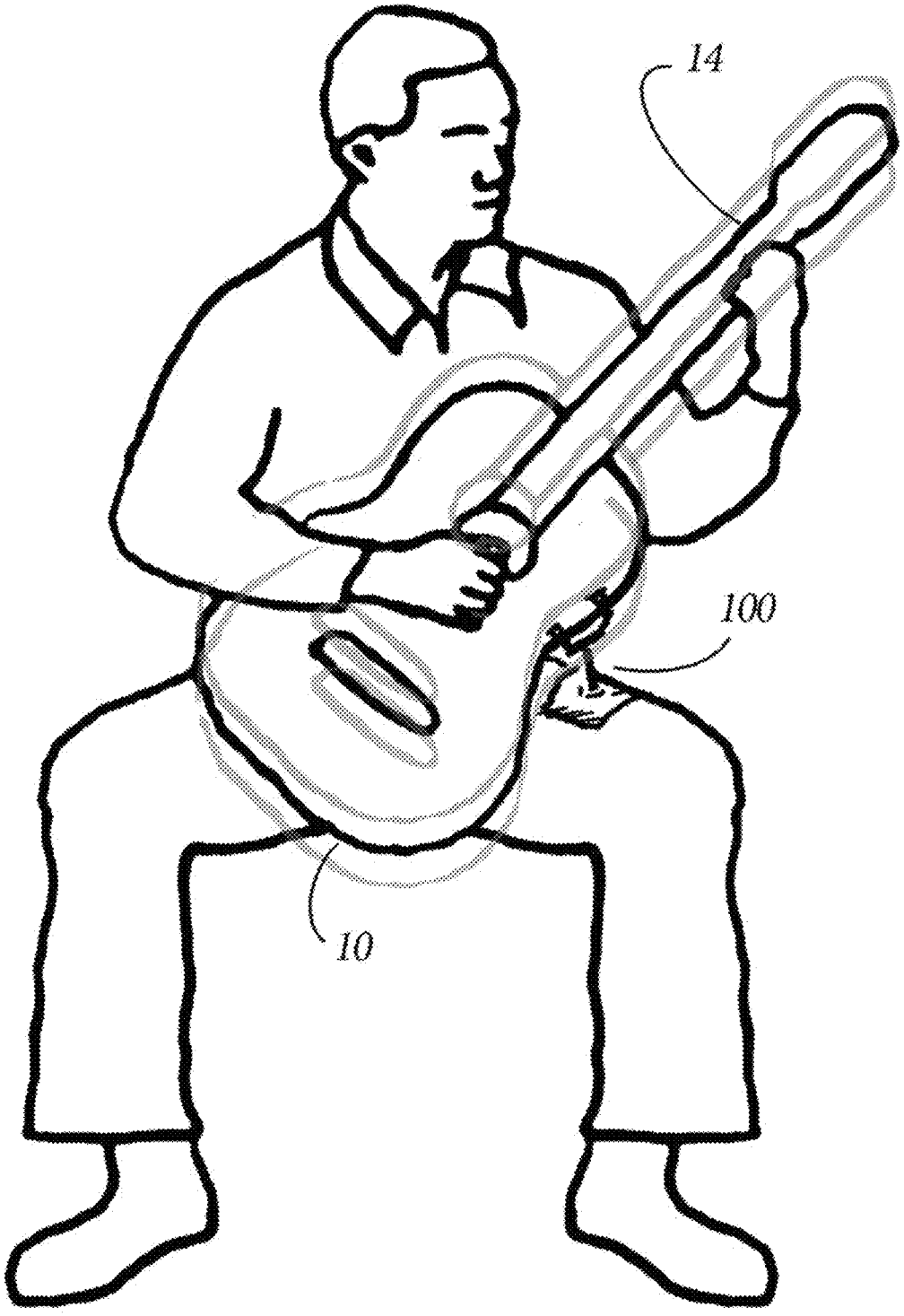
FIG. 2 depicts a musician utilizing an embodiment of the present invention, with the blurring of the drawing indicating the different elevated positions a musician may hold an instrument to achieve a preferred playing position suitable for the musician's body type and the shape and size of the instrument.
Figure 3:
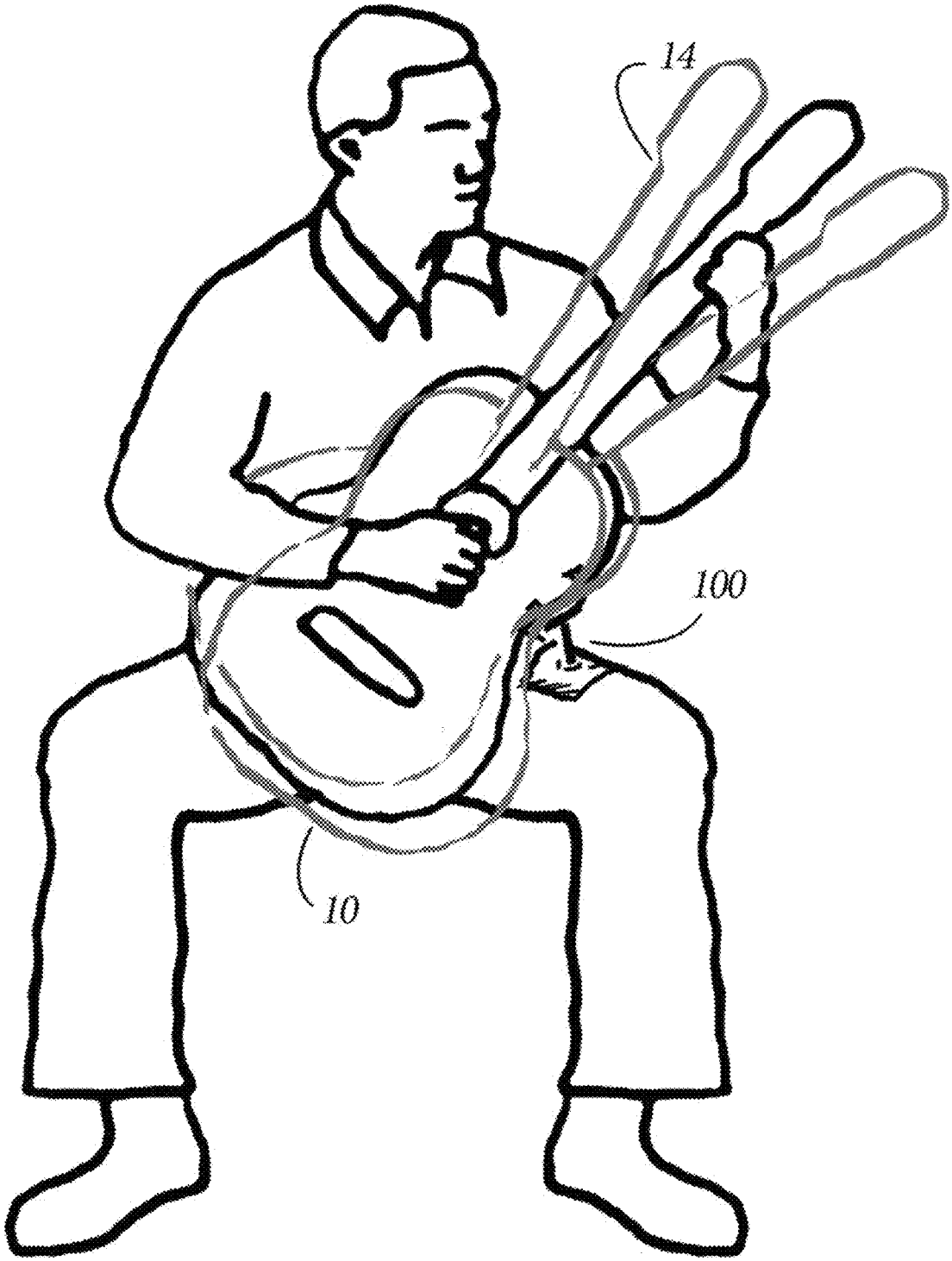
FIG. 3 depicts a musician utilizing an embodiment of the present invention, showing the variety of available neck angle positions the musician may utilize with embodiments of the present invention to achieve a preferred position.
Figure 4:
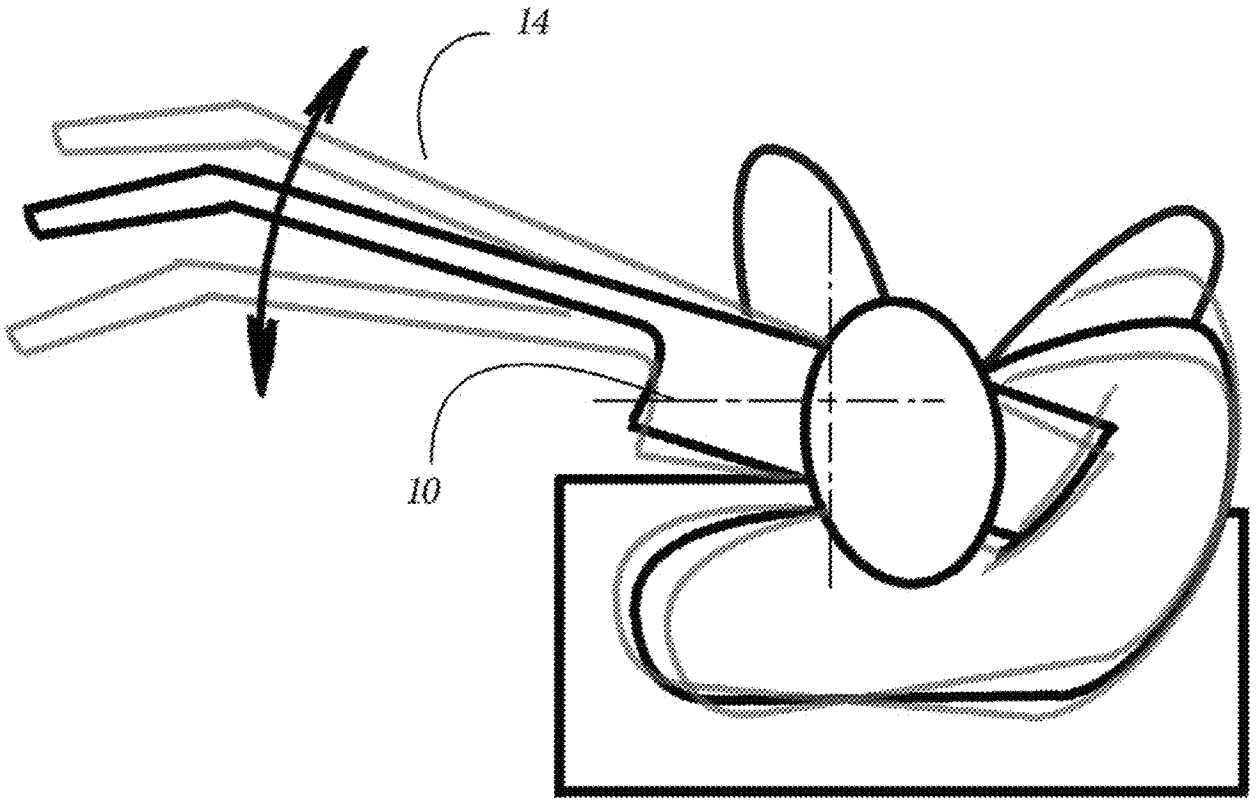
FIG. 4 depicts a top view of a musician playing an instrument, with the figure indicating the "center of rotation" or axis of rotation about which the instrument is free to rotate, and indicating the approximate placement of the musical instrument support with respect to the musician's body.

The solution to the above-described problem is to use a support device between the musician's leg and the upper bout section 18. The musical instrument support 100 of the present invention provides such a support device. Embodiments of the musical support 100 provide several desired features not found in the prior art supports. As depicted in FIGS. 2-3, embodiments of the musical support 100 allow the musician to change the position of the musical instrument 10 to achieve a preferred playing position by the musician. It is to be noted that the musician can keep both feet on the ground while still maintaining the musical instrument 10 in an optimal playing position. FIG. 3 depicts the variety of different positions of the instrument body 12 and neck 14 which are available to a musician with the musical instrument support, with the support 100 providing support between the musician's leg and the musical instrument. FIG. 4 depicts the ability of a musician using an embodiment of the musical instrument support 100 to pivot the instrument about an axis of rotation during a musical performance. Embodiments of the present invention continue to provide support between the musician's leg and the musical instrument 10 with this type of motion.

Figure 5:
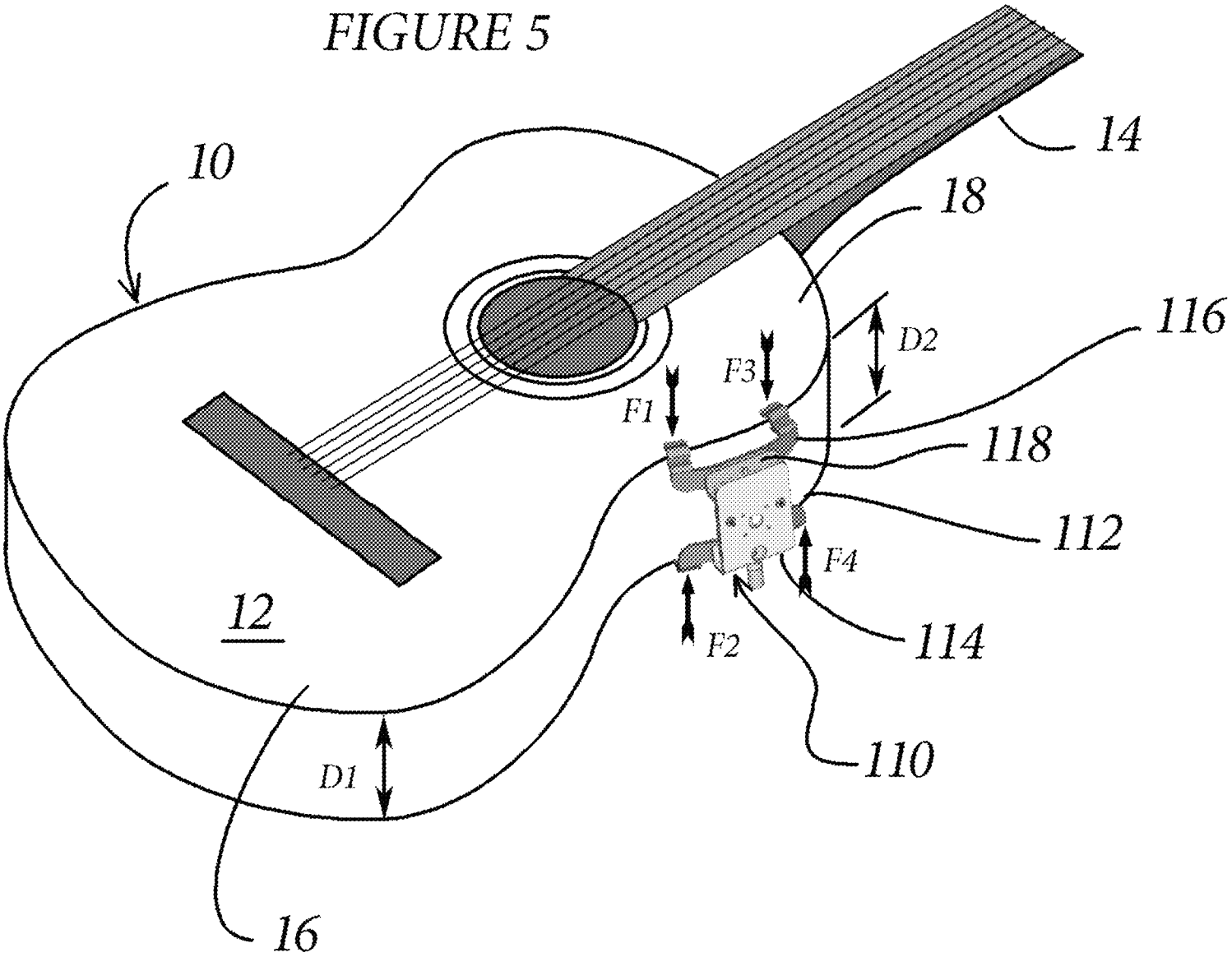
FIG. 5 depicts an embodiment of the instrument support member of the present invention utilized on an instrument having a uniform thickness of the instrument body.

FIG. 5 depicts an instrument support member 110 attached to the upper bout section 18 of a musical instrument 10, where the thickness D1 of the lower bout section 16 is equivalent to the thickness D2 of the upper bout section 18. Instrument support member 110 has a first instrument clamp member 112 pivotally attached to a base member 114 and a second instrument clamp member 116 pivotally attached to a shuttle member 118. First instrument clamp member 112 is attached to base member 114 with a fastener, pin, rivet, etc. which allows the first instrument clamp member 112 to freely pivot with respect to base member 114. Likewise, second instrument clamp member 116 is attached to shuttle member 118 with a fastener, pin, rivet, etc., which allows second clamp member 116 for freely pivot with respect to shuttle member 118. With this configuration, first clamp member 112 and second clamp member 116 also pivot independently with respect to each other.

Figure 6:
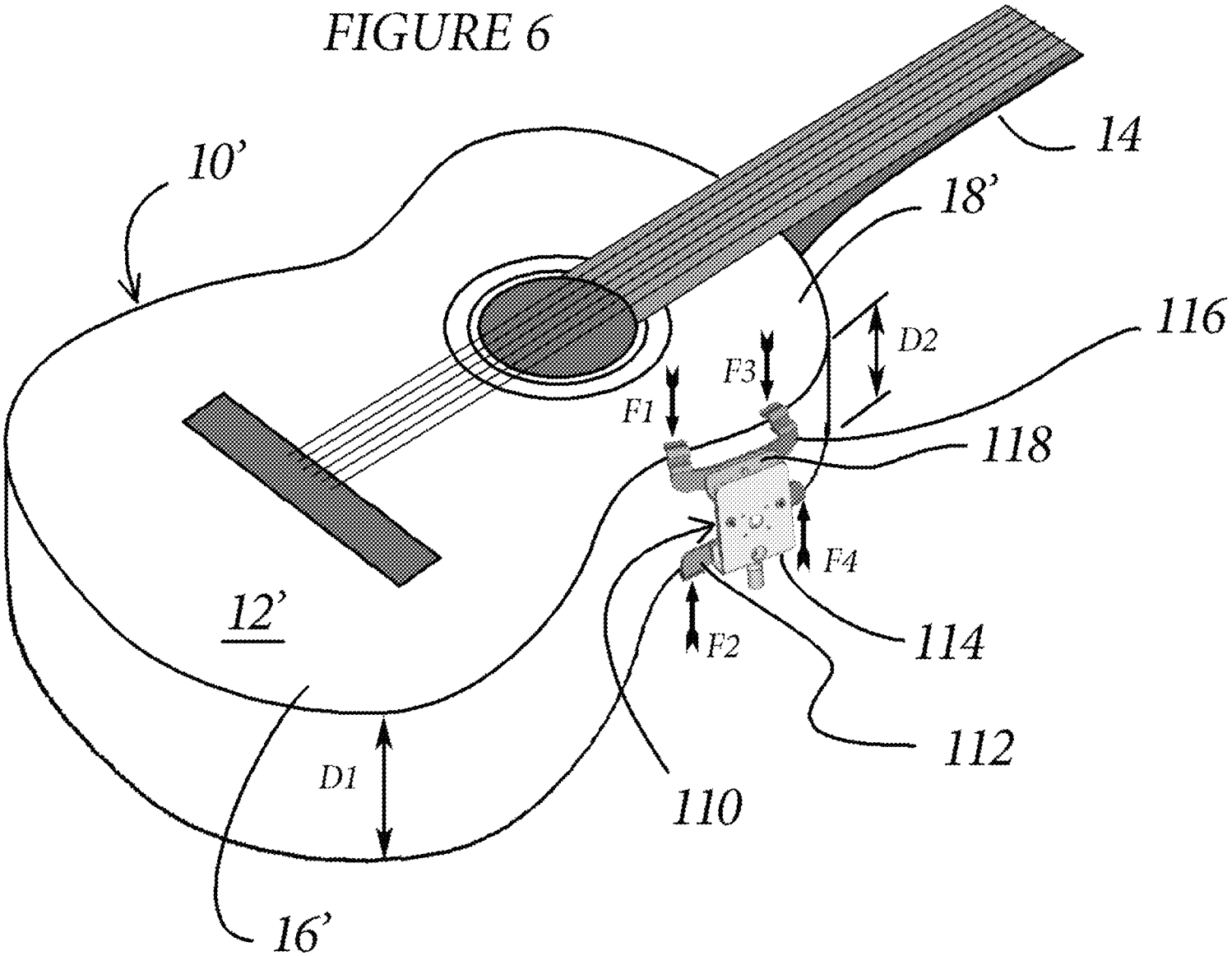
FIG. 6 depicts an embodiment of the instrument support member of the present invention utilized on an instrument having a body thickness which decreases between the back and the front of the instrument.

FIG. 6 illustrates the benefits of the first instrument clamp member 112 pivoting independently from second instrument clamp member 116. FIG. 6 depicts an instrument support member 110 attached to the upper bout section 18' of a musical instrument 10' where the thickness D1 of the lower bout section 16' is greater than the thickness D2 of the upper bout section 18.' While conventional clamp supports will work with a musical instrument 10 having a uniform body thickness at the lower bout 16 and the upper bout 18, as depicted in FIG. 5, these supports will not clamp adequately on a musical instrument such as that depicted in FIG. 6, where the thickness of the instrument body 12' varies between the lower bout section 16' and the upper bout section 18'. However, with the pivoting clamp members of the instrument support member 110, the independent pivoting feature of the first instrument clamp member 112 and the second instrument clamp member 116 allow the clamps to adjust to instrument bodies 12' having changing thicknesses, thereby allowing the clamps to securely attach to the instrument body.

Figure 7:
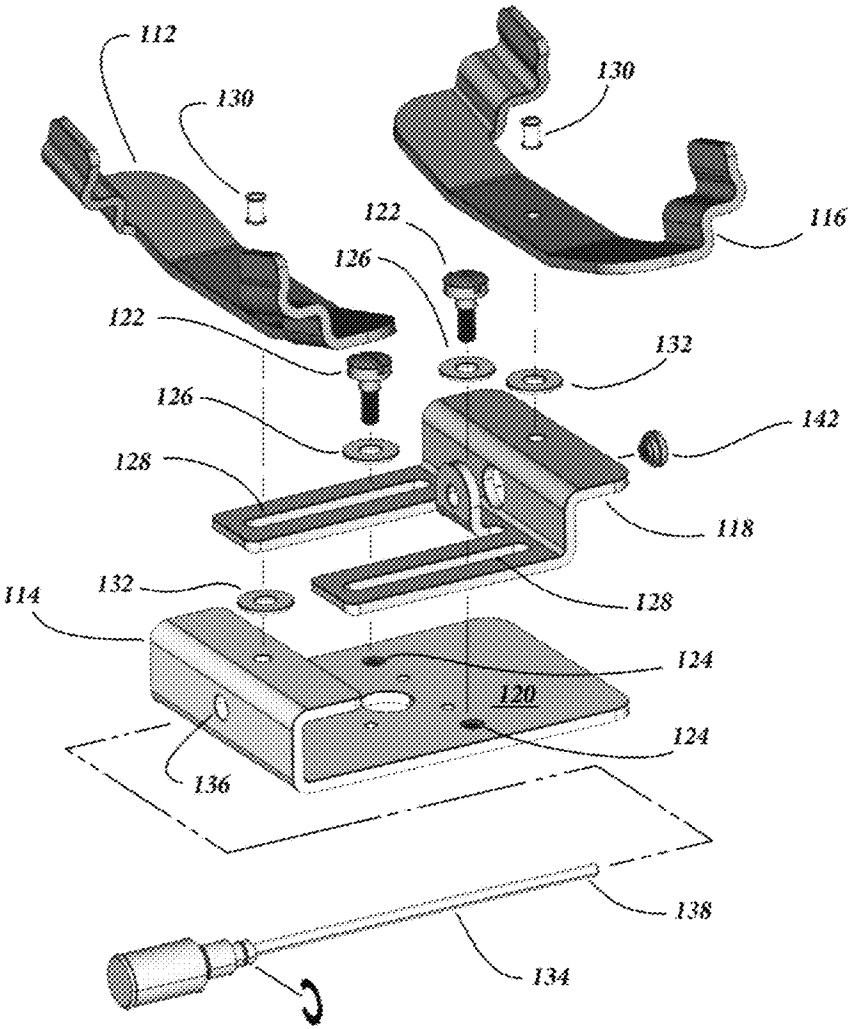
FIG. 7 depicts an exploded view of an embodiment of the instrument support member of the present invention.

As shown in the exploded view of FIG. 7, shuttle member 118 is slidingly attached to base member 114, with the shuttle member configured to slide along the top face 120 of the base member. Shuttle member 118 may be attached to base member 114 with fasteners 122 to threaded apertures 124 in the base member 114, with flat washers 126 which are placed over parallel slots 128 of the shuttle member. As further shown in FIG. 7, first instrument clamp member 112 may be pivotally attached to base member 114 with rivet 130 with flat washer 132 disposed between the first instrument clamp member 112 and the base member 114. Likewise, second instrument clamp member 116 may be pivotally attached to shuttle member 118 with rivet 130 with flat washer 132 disposed between the second clamp member 116 and the shuttle member 118. FIG. 7 also shows a pin 134 which may be used to translate the shuttle member 118 along the top face 120 of the base member 114, where pin 134 extends through an aperture 136 in the base member, with pin 134 having an end 138 which attaches to the shuttle member 118. In this configuration, movement of the pin 134 may be used to translate shuttle member 118 move back and forth with respect to base member 114. In some embodiments of the invention, end 138 may extend through retainer tab 140 of the shuttle member 118 and secured by nut 142.

Figure 8:
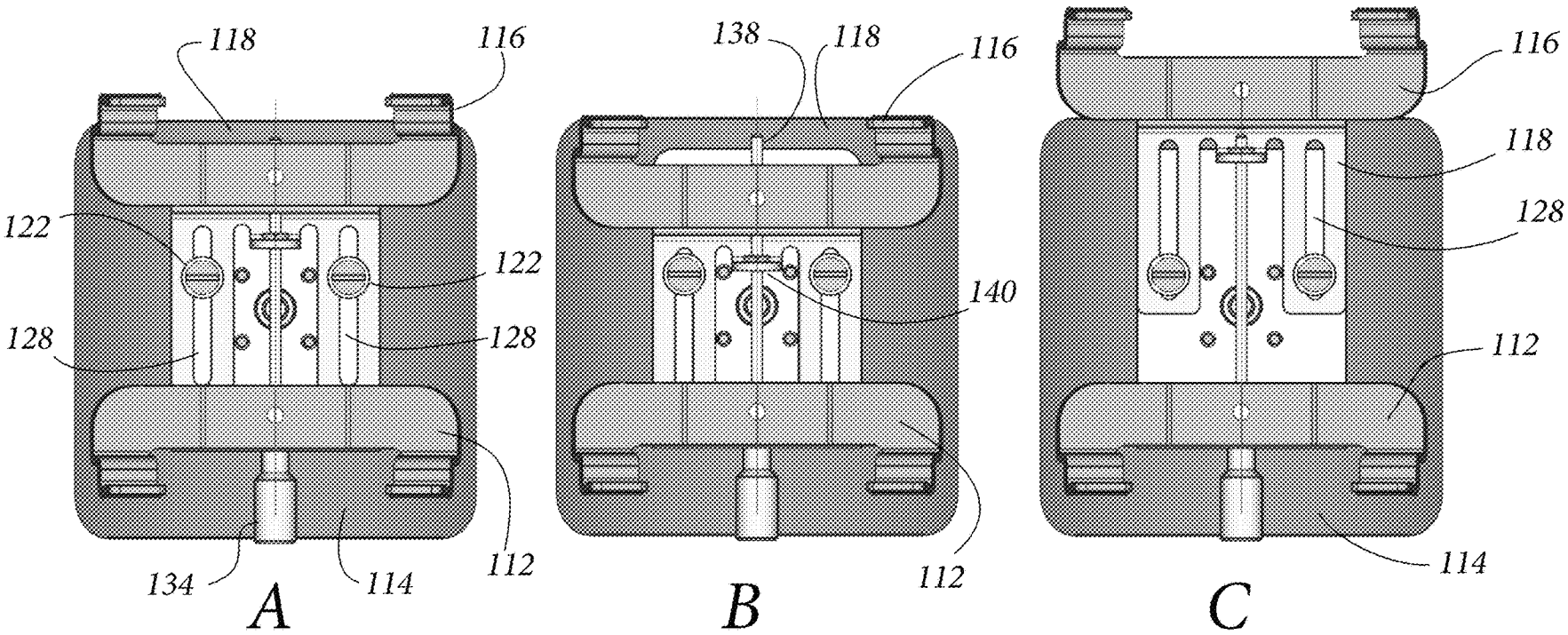
FIGS. 8A through 8C depicts how the clamp members of an embodiment of the instrument support member of the present invention may be translated toward and away from each other.
Figure 9:
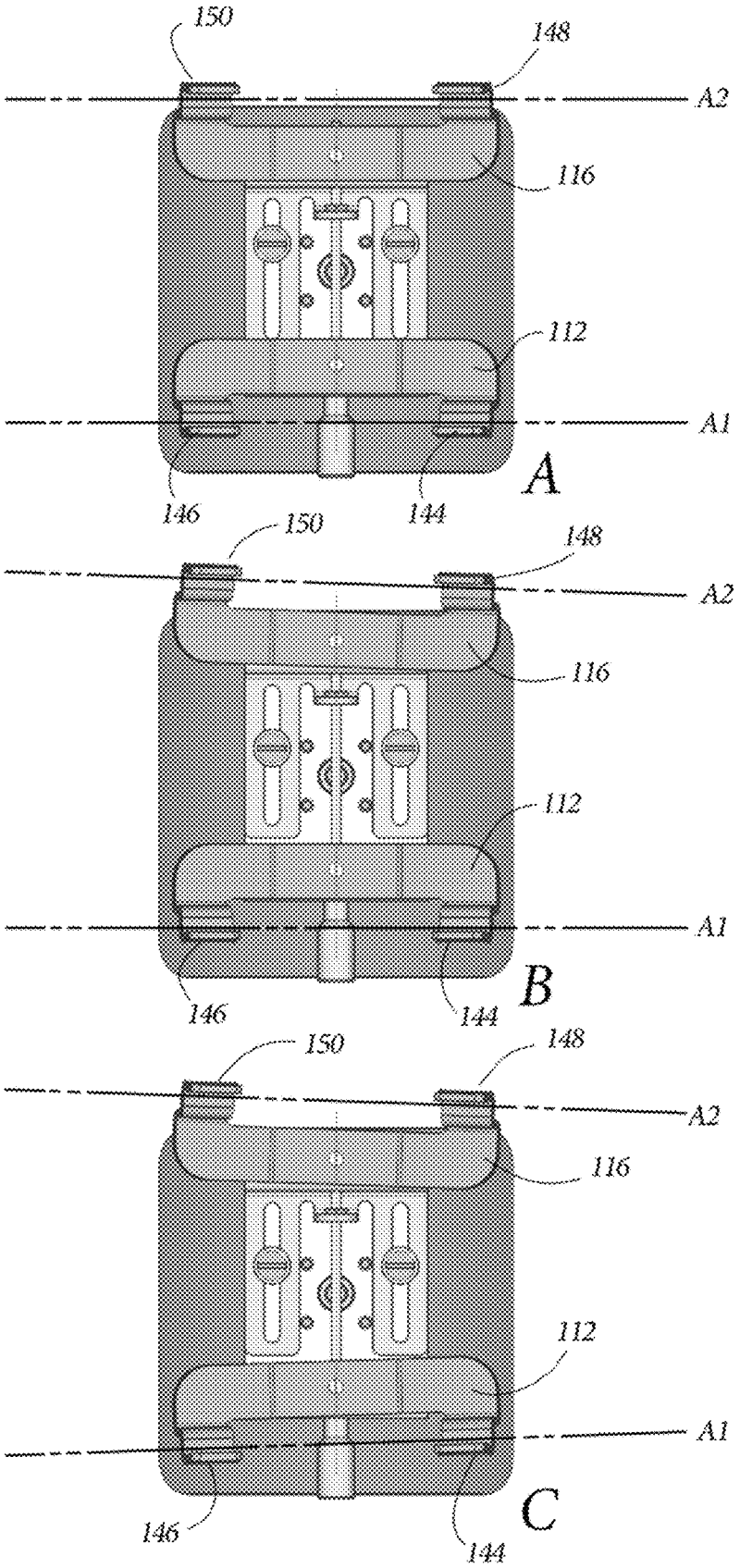
FIGS. 9A through 9C depicts how the clamp members of an embodiment of the instrument support member of the present invention may be pivoted independently from each other to accommodate a varying body thickness of a musical instrument.

FIGS. 8A through 8C depict shuttle member 118 being translated to different positions with respect to base member 114 by the movement of pin 134. FIGS. 9A through 9C show how first instrument clamp member 112 and second instrument clamp member 116 may pivot independently of one another. First instrument clamp member 112 may comprise a front gripper 144 and a rear gripper 146 with front gripper 144 and rear gripper 146 in axial alignment along axis $A_1$. Likewise, second instrument clamp member 116 may comprise a forward gripper 148 and a rearward gripper 150 in axial alignment along axis $A_2$. Axes $A_1$ and axis $A_2$ may also respectively represent the orientation of the top edge and the bottom edge of the body of a musical instrument.

FIG. 9A depicts a configuration where axis $A_1$ and axis $A_2$ are parallel, which is shows the relative positions of the first instrument clamp member 112 and the second instrument clamp member 116 for an instrument having a uniform body thickness. However, in FIGS. 9B and 9C, the axis $A_1$ and axis $A_2$ are not parallel, indicating the relative positions of the first instrument clamp member 112 and the second instrument clamp member 116 for an instrument having a non-uniform body thickness. FIG. 9B shows a configuration where forward gripper 148 of second instrument clamp member 116 has pivoted toward front gripper 144 of first instrument clamp member 112. This configuration would be appropriate for an instrument, for example, having a top which tapers toward the bottom of the instrument along the length of the body of the instrument. FIG. 9C shows a configuration we gripper 148 and gripper 144 each pivot toward the other. This configuration would be appropriate for an instrument, for example, where the top of the instrument and the bottom of the instrument taper toward one another along the length of the instrument.

Figure 10:
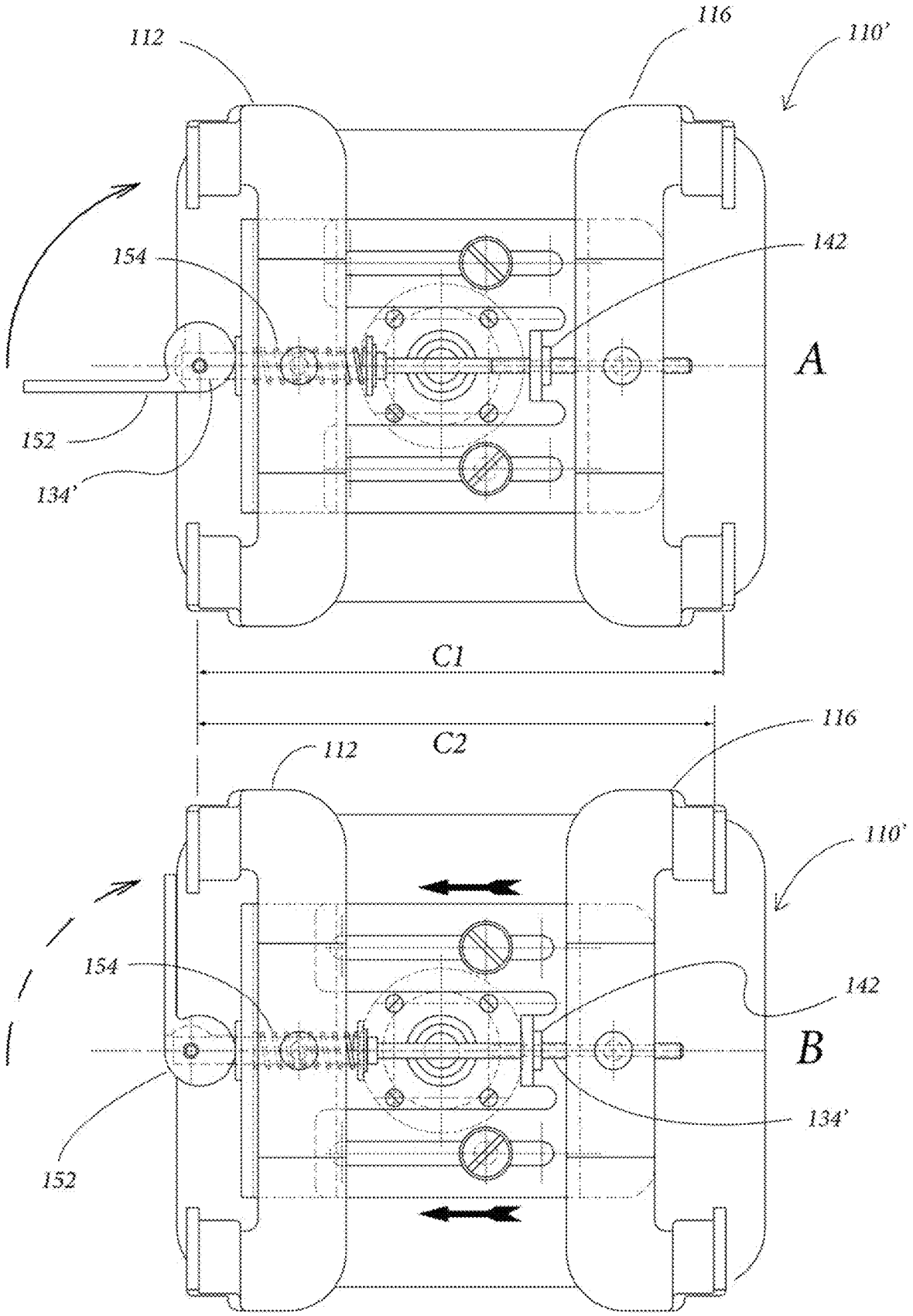
FIGS. 10A and 10B show how a cam and lever actuator may be utilized to urge the second instrument clamp member toward the first instrument clamp member.

FIGS. 10A and 10B show an embodiment of an instrument support member 110' which has a cam and lever actuator 152 which may be used to move the pin 134' as the lever is rotated from a position which is approximately parallel with pin 134' to a position which is approximately perpendicular to pin 134', thereby drawing the pin through aperture 136 and translating second instrument clamp member 116 toward first instrument clamp member 112, placing the instrument support member 110' into a closed position. An optional biasing mechanism, such as spring 154, may be utilized to urge the clamp member 110' into the open position. Pin 134' may have a threaded end which makes up to nut 142. The threaded end and nut combination allows the distance between the first instrument clamp member 112 and second instrument clamp member 116 to be adjusted to the approximate desired distance C1, where operating the cam and lever actuator moves the instrument support member 110' into the closed position having distance C2 between the first instrument clamp member 112 and second instrument clamp member 116. The use of cam and lever actuator 152 provides a rapid means of allowing a musician to attach and detach the instrument support member 110' from the musical instrument 10.

Figure 11:
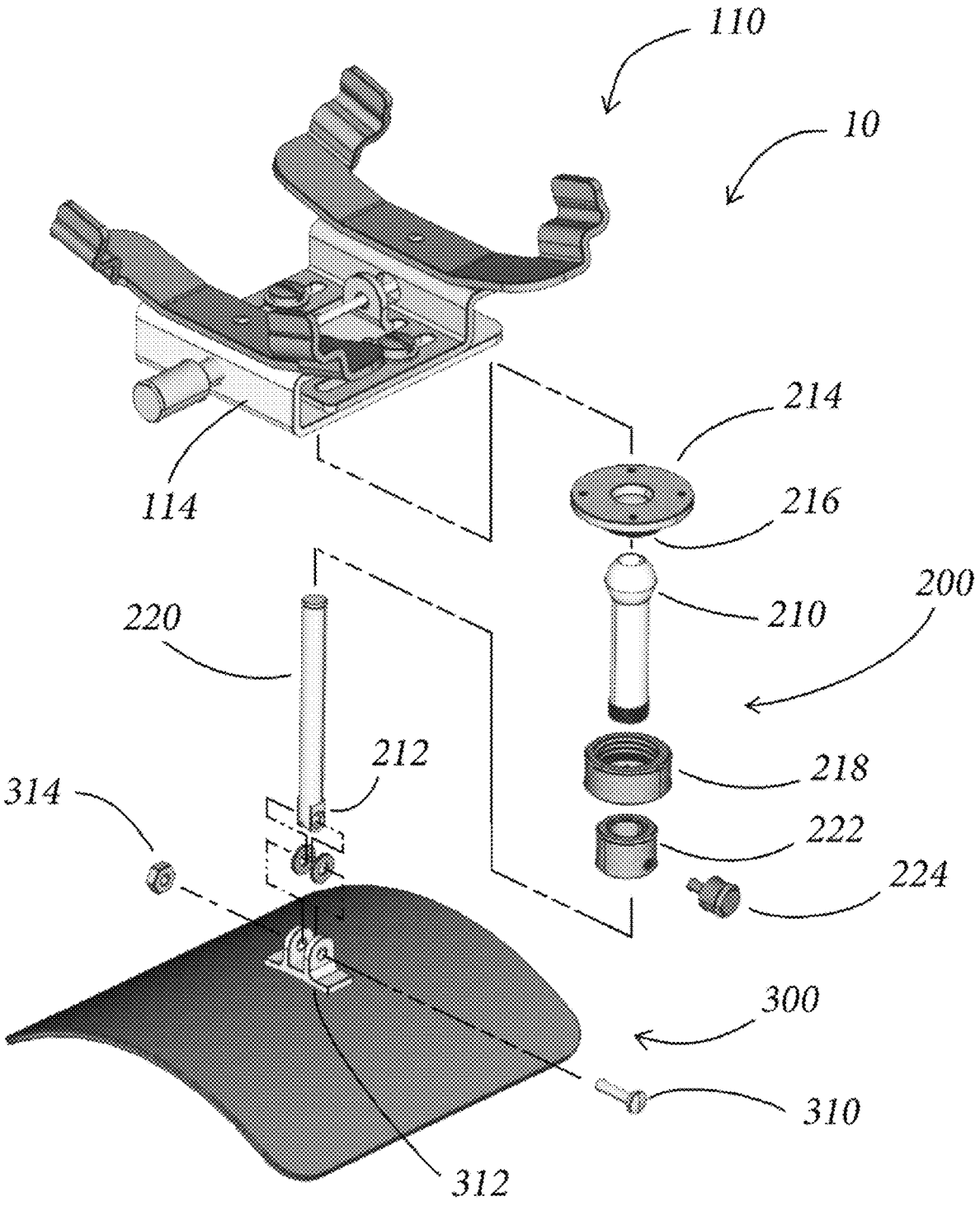
FIG. 11 depicts an embodiment of the musical instrument support, showing an exploded view of an embodiment of a support pillar.
Figure 12:
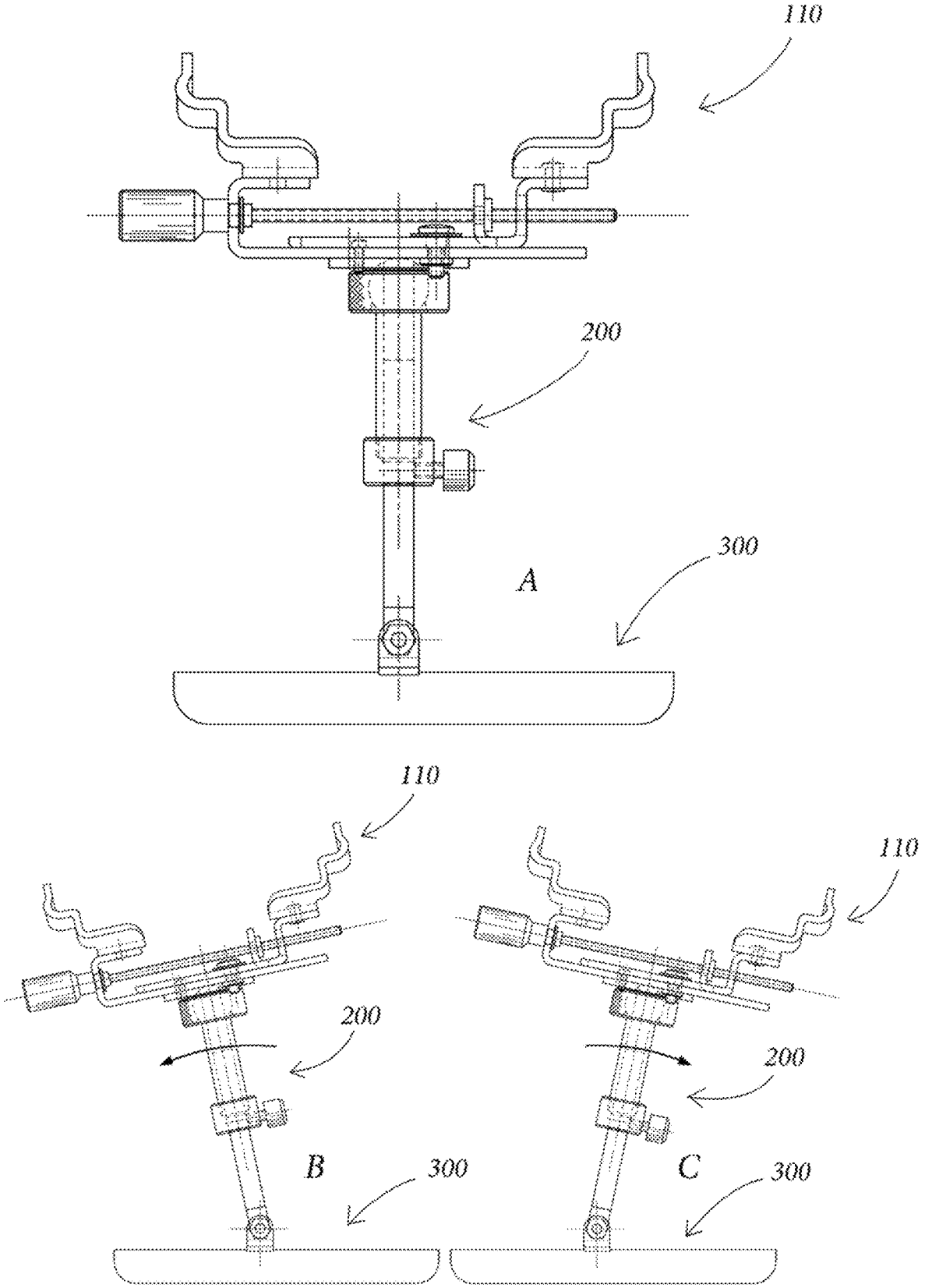
FIGS. 12A through 12C depicts how an embodiment of the present invention has a musical instrument support member which is both pivotal and rotational with respect to the leg support member.
Figure 13:
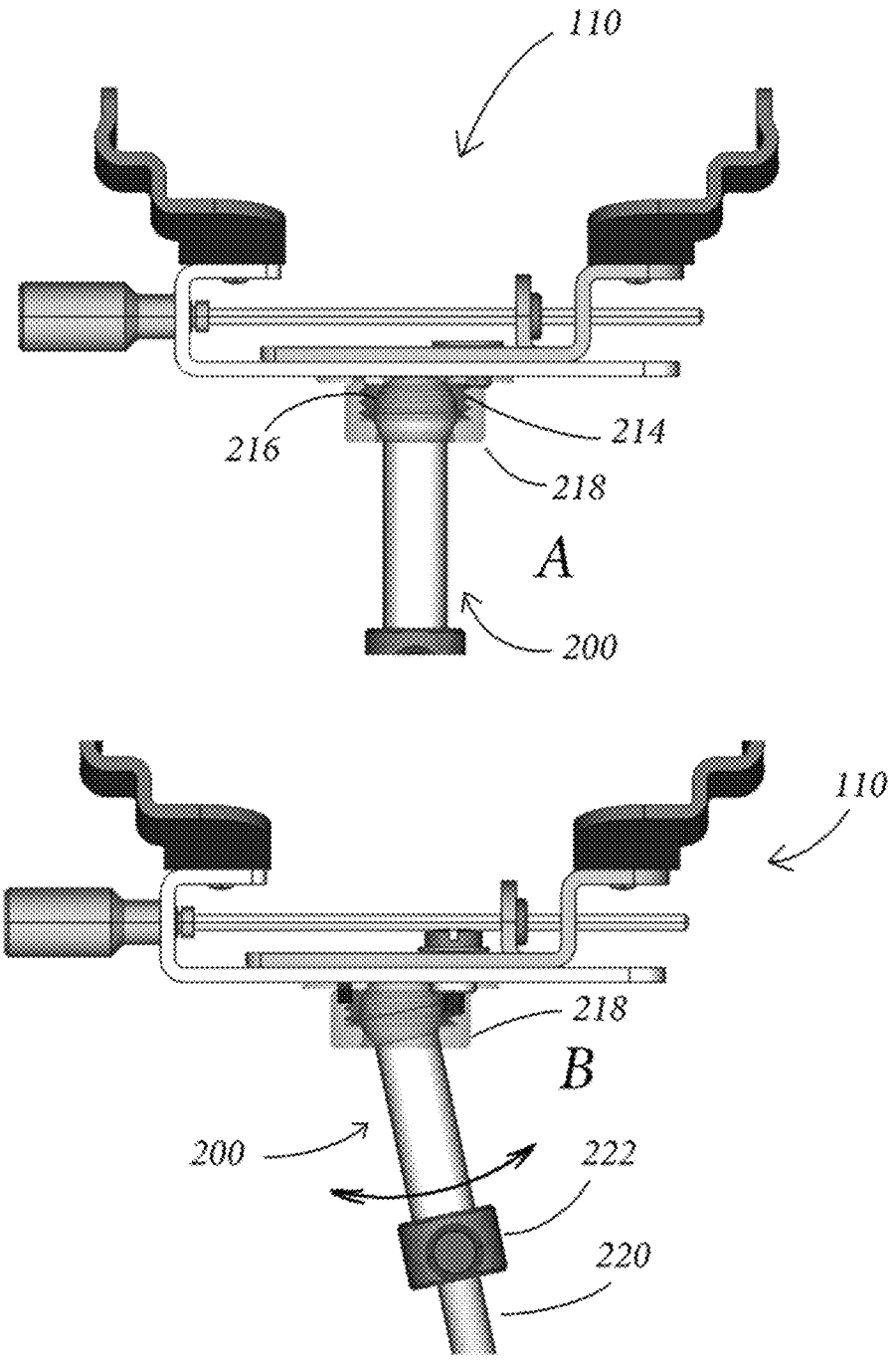
FIGS. 13A and 13B depict how an embodiment of the musical support member may be pivotally adjusted with respect to an embodiment of an instrument support pillar.
Figure 14:
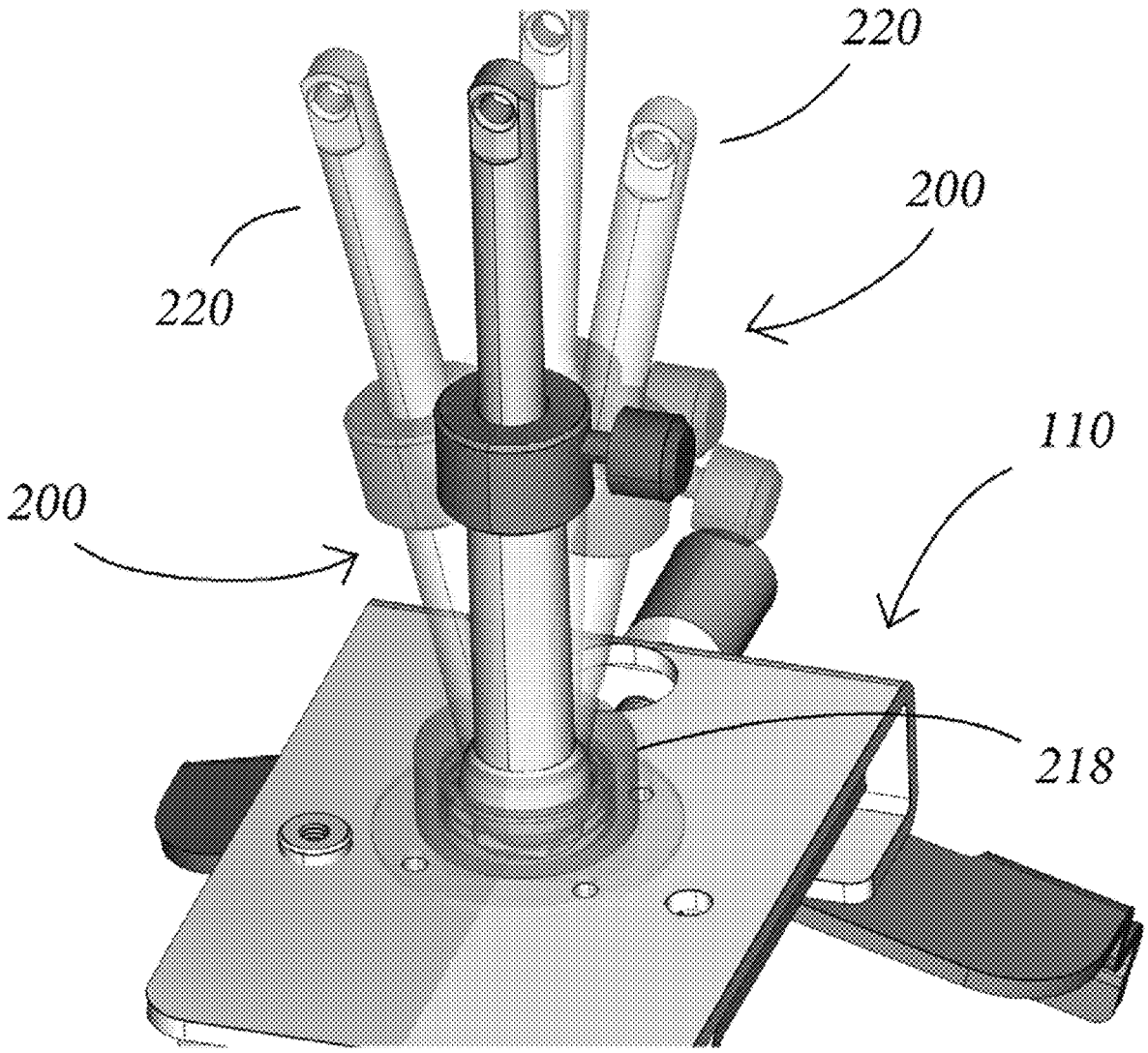
FIG. 14 is a bottom view of the musical instrument support member, showing the adjustability of an embodiment of the instrument support pillar with respect to the musical instrument support member by operation of a ball and socket.

FIG. 11 depicts an embodiment of the musical instrument support 100 showing instrument support member 110 and an exploded view of an embodiment of a support pillar assembly 200. As shown in FIG. 11, support pillar assembly 200 may be attached to a leg support member 300. Support pillar assembly 200 may have a ball end rod 210 which attaches to the base member 114 of instrument support member 110. Support pillar assembly 200 has a second end 212 which may be pivotally attached to leg support member 300 by a screw 310 which is inserted through bracket 312 and retained by nut 314. Alternatively, the second end 212 may attach to other support structures, including the floor, which would allow the musician to play the instrument in a posture utilized by cello players. In this embodiment, support pillar assembly 200 may configured telescopically to allow the length to be adjusted as desired.

A socket member 214 may be utilized to attach ball end rod 210 to base member 114 with the ball end of ball end rod 210 received within socket member 214. Socket member 214 may have exterior threads 216. A retaining cup 218 may be made up onto threads 216, thereby attaching support pillar 200 to instrument support member 110. As depicted in FIG. 12A through FIG. 12C, FIG. 13A and FIG. 13A and FIG. 14, with this configuration, the position of support pillar 200 may be adjusted with respect to the attitude of the instrument support member 110 and locked into a desired position by tightening of the retaining cup 218 onto the exterior threads 216. This feature of the invention provides great flexibility to the musician to position the instrument at a variety of angles with respect to the musician's body, thereby allowing the musician to achieve an optimal position of the instrument with respect to the musician's body, arms, and hands.

Figure 15:
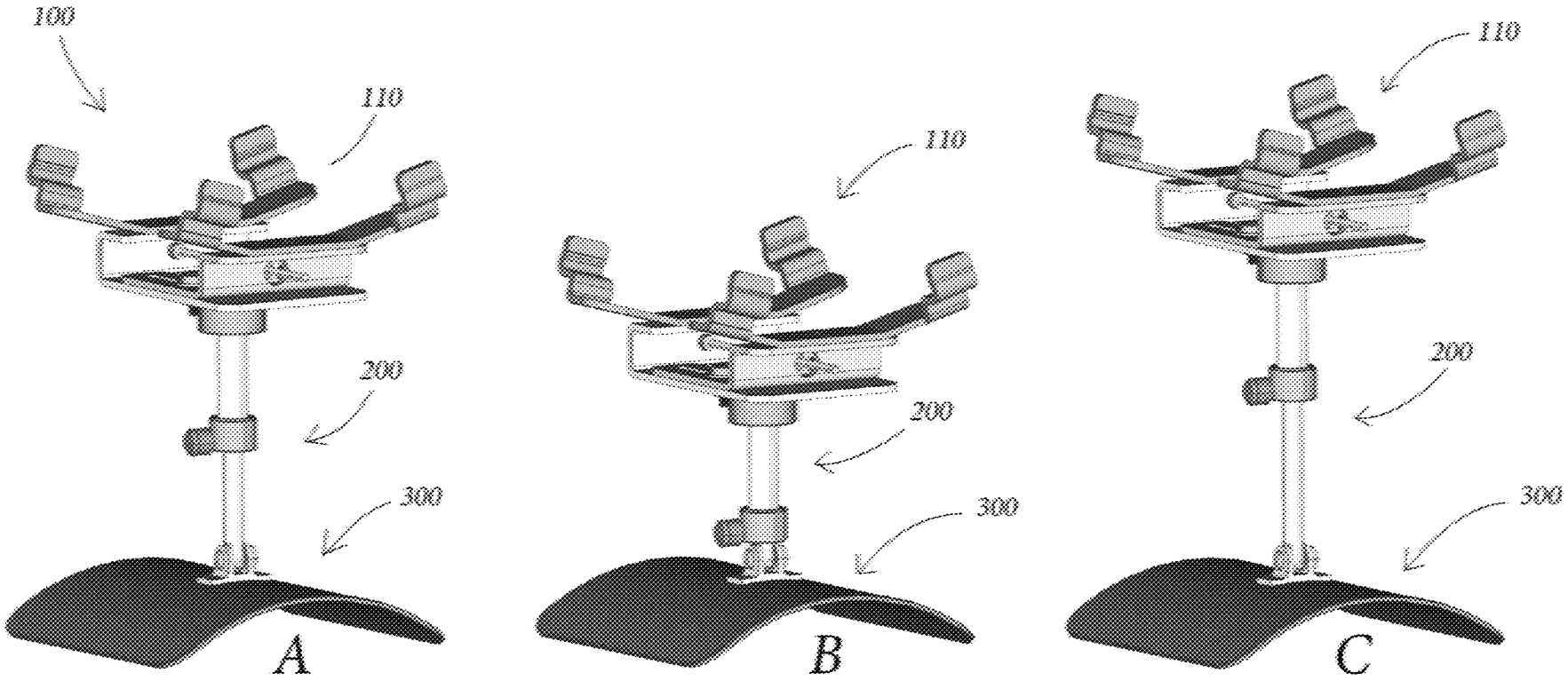
FIGS. 15A through 15C depict an embodiment of the musical instrument support showing how the height of the musical instrument support member may be changed by adjusting the length of the instrument support pillar.

Support pillar 200 may have an extension rod 220 attached to it. Extension rod 220 may be attached to support pillar 200 by collar member 222. Extension rod 220 may be inserted into support pillar 200 and extension rod 220 may telescope within support pillar 200. As depicted in FIGS. 15A through 15C, this configuration allows adjustment of the distance between instrument support member and leg support member 300, with the distance maintained by a screw 224. This feature of the invention allows the musician to adjust the distance between the instrument and the musician's leg which supports leg support member 300, thereby allowing the musician to place the instrument at an optimal height above the musician's leg.

Figure 16:
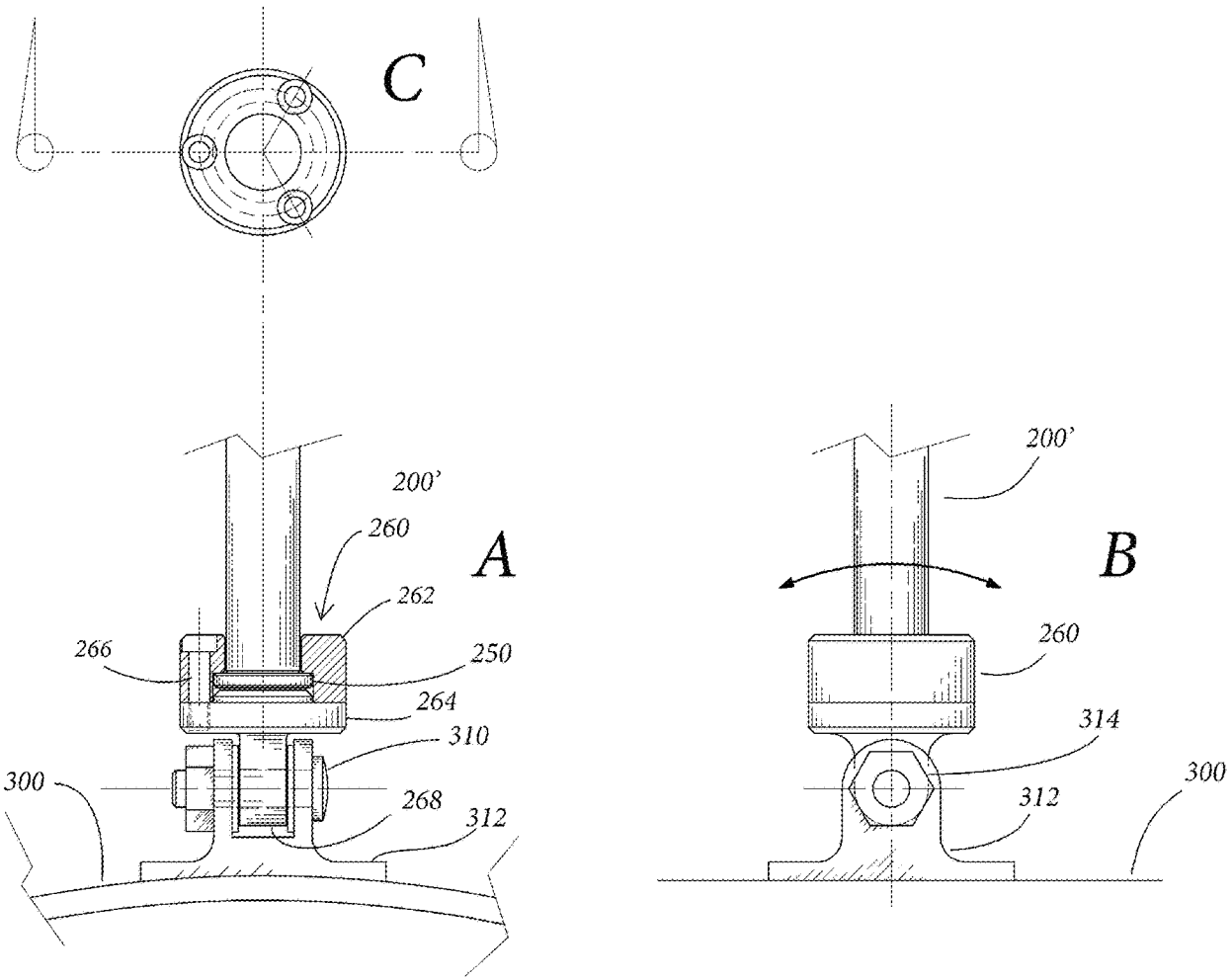
FIGS. 16A through 16C show an embodiment of an attachment apparatus between the instrument support pillar and the leg support member, with 16A showing front partial sectional view, 16B showing a side view and 16C showing a top view.

FIGS. 16A through 16C show an embodiment of an attachment apparatus between an embodiment the instrument support pillar 200' and the leg support member 300. In this embodiment, support pillar 200' has an end 250 which is retained within swivel coupling 260 by use of a flare, lock ring or similar structure at end 250. Swivel coupling 260 has a top member 262 which is attached to bottom member 264 by screws 266 or other attachment mechanism thereby capturing end 250 within the split collar 260, but which allows the free rotation of support pillar 200'. Swivel coupling 260 has a bottom clevis member 268 which pivotally attaches to bracket 312 by screw 310. The embodiment shown in FIG. 16A through FIG. 16A allow a musician to rotate the instrument about the axis of the support column 200' thereby allowing the musician increased flexibility in moving and positioning of an instrument during a performance or practice.

Figure 17:
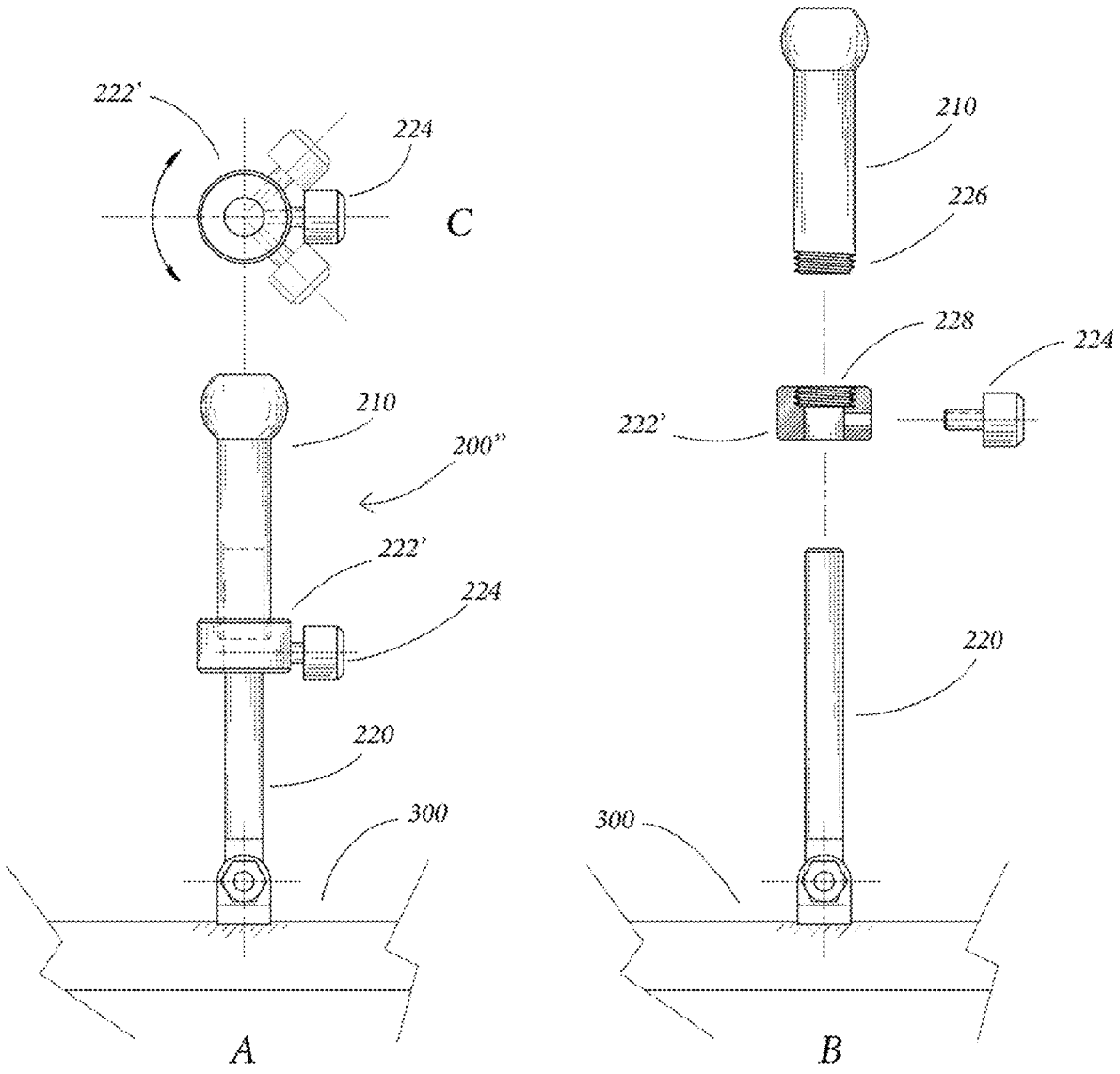
FIGS. 17A through 17C depict an embodiment of the instrument support pillar, with 17A showing a side view of the instrument support pillar attached to a leg support member, 17B showing an exploded view of the instrument support pillar, and 17C showing a top view of the instrument support pillar.
Figure 18:
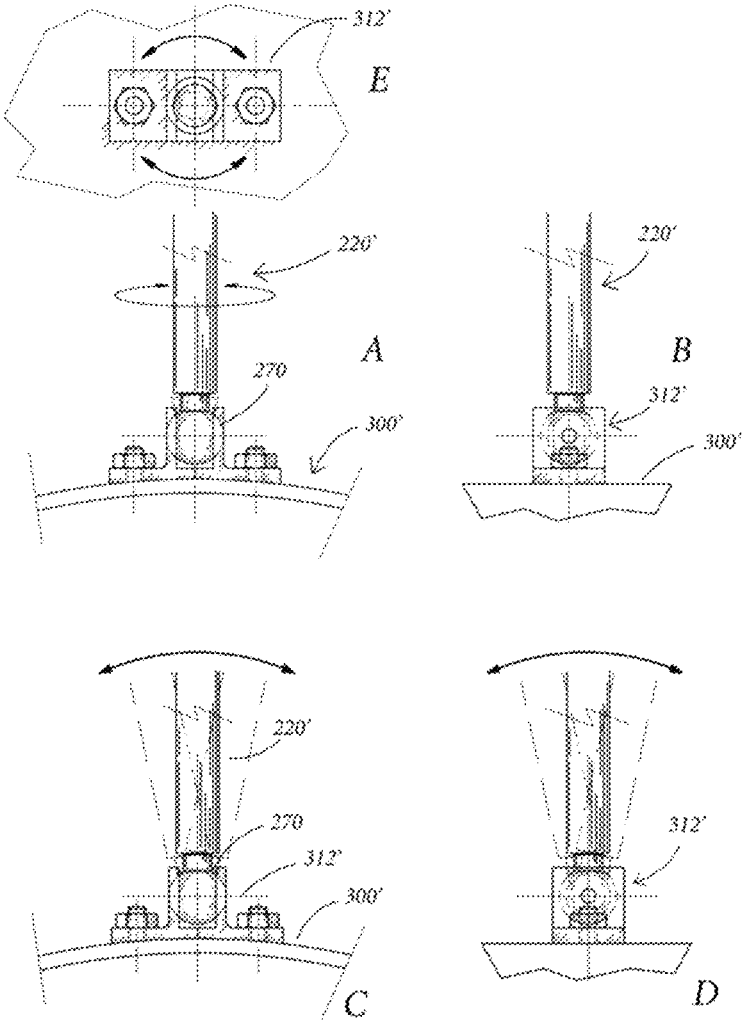
FIGS. 18A through 18E show an embodiment of an attachment apparatus between the instrument support pillar and the leg support member.
Figure 19:
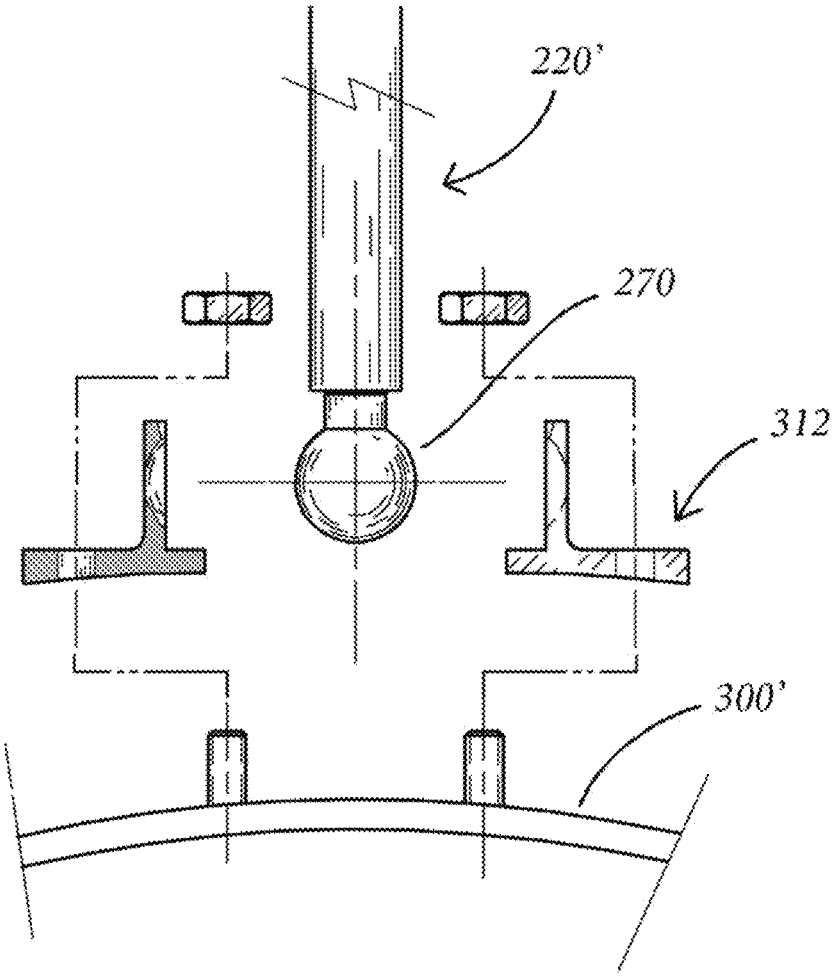
FIG. 19 shows an exploded view of the attachment apparatus depicted in FIGS. 18A through 18E.

FIGS. 17A through 17C show an embodiment of the instrument support pillar 200" which provides an alternative structure for allowing rotation of the instrument about the instrument support pillar 200" comparable to the embodiment depicted in FIGS. 16A through 16C. This embodiment of instrument support pillar 200" has a ball end rod 210 comparable to the instrument support pillar 200 discussed above. The end opposite the ball of ball end rod 210 has exterior fine threads 226 which received within fine threads 228 of collar 222'. Collar 222' connects ball end rod 210 extension rod 220 which is received within ball end rod 210 and locked into place by screw 224, which allows vertical adjustment by the amount of the extension rod inserted within the ball end rod. The attachment of the ball end rod 210 to collar 222' by fine threads allows free rotation of ball end rod 210 as indicated in FIG. 17C—and thus free rotation of instrument support member 110 about leg support member 300.

FIGS. 18A through 18E and FIG. 19 show an embodiment of an attachment apparatus between an embodiment of the extension rod 220' attached to support pillar 200 at its upper end and an embodiment of the leg support member 300'. In this embodiment, extension rod 220' has a ball end 270 which is retained within a bracket 312' which is configured to receive and retain ball end 270 and allow the free rotation of extension rod 220' with respect to support pillar 200. The embodiment shown in FIGS. 18A through 18E and FIG. 19 allow a musician to rotate the instrument about the axis of the extension rod 220' thereby allowing the musician increased flexibility in moving and positioning of an instrument during a performance or practice.

Having thus described the preferred embodiment of the invention, what is claimed as new and desired to be protected by Letters Patent includes the following:

The invention claimed is:

1. A musical instrument support comprising:

an instrument support member comprising a first instrument clamp member pivotally attached to a base member and a second instrument clamp member pivotally attached to a shuttle member, the first instrument clamp member configured to pivot independently from the second instrument clamp member and the second instrument clamp member configured to pivot independently of the first instrument clamp member, the shuttle member slidingly attached to the base member, the instrument support member further comprising a shuttle member translation mechanism which translates the shuttle member along a surface of the base member from a first position to a second position, the second instrument clamp member configured to move towards the first instrument clamp member when the shuttle member is translated to the first position and the second instrument clamp member configured to move away from the first instrument clamp member when the shuttle member is translated to the second position.

2. The musical instrument support of claim 1 wherein the shuttle translation mechanism comprises a pin which extends through an aperture in the base member, the pin having a first end which is retained at the aperture and a second end which is attached to the shuttle member, wherein movement of the pin in a first direction translates the shuttle member towards the first position and movement of the adjustment screw in a second direction translates the shuttle member towards the second position.

3. The musical instrument support of claim 2 further comprising a cam and lever actuator configured to move the pin in the first direction and in the second direction upon actuation of the cam and lever actuator.

4. The musical instrument support of claim 1 further comprising a support pillar having a first end attached to the base member.

5. The musical instrument support of claim 4 comprising a leg support member pivotally attached to a second end of the support pillar.

6. The musical instrument support of claim 4 wherein a socket member is attached to the base member and the first end of the support pillar comprises a ball end which is received within the socket member, thereby allowing the support pillar to be pivoted with respect to the base member.

7. The musical instrument support of claim 6 wherein the socket member comprises threads configured to receive a retaining cup, wherein the tightening of the retaining cup upon the threads of the socket member restrains a support pillar ball end from movement.

8. The musical instrument support of claim 5 further comprising an extension rod which attaches to the support pillar.

9. The musical instrument support of claim 8 wherein the extension rod is attached to the support pillar by a collar member disposed between the extension rod and the support pillar.

10. The musical instrument support of claim 8 wherein the extension rod and the support pillar configured into a telescoping unit configured to allow a variable length between the instrument support member and the leg support member.

11. The musical instrument support of claim 9 wherein the collar member is configured to allow rotation between the extension rod and the support pillar thereby allowing rotation between the instrument support member and a leg support member.

12. A support pillar for a musical instrument, the support pillar to be disposed between a musical instrument support structure at an upper end of the support pillar and a supporting surface at a lower end of the support pillar, the support pillar comprising:

a hollow upper pillar member having a first end comprising a first ball member to be received within a first socket attached to the musical instrument support structure and a second end comprising external threads;

a collar member having a top end having internal threads configured to engage the external threads of the second end, the collar member further comprising a bottom end, wherein the collar member comprises an opening extending from the top end to the bottom end;

a lower pillar member comprising a shaft having a first end configured to be received within the collar member and a second end for attachment to the support surface; and a fastening mechanism which retains the first end of the lower pillar member within the collar member.

13. The support pillar of claim 12 wherein the supporting surface at the lower end of the support pillar comprises a leg support member.

14. The support pillar of claim 13 wherein the leg support member comprises a second socket, wherein the second end of the lower pillar member comprises a second ball member to be received within the second socket.

15. The support pillar of claim 12 wherein the hollow upper pillar member is rotatable with respect to the collar member.

16. The support pillar of support 12 wherein the lower pillar member and collar member are configured into a telescoping unit configured to allow a variable length between the musical instrument support structure instrument and the supporting surface.

17. An apparatus for supporting a musical instrument comprising:

a clamping mechanism comprising a first clamp member attached to a base member and a second clamp member attached to a shuttle member, the shuttle member slidingly attached to the base member, the first clamp member comprising a front gripper and a back gripper in axial alignment, the second clamp member comprising a forward gripper and a rearward gripper in axial alignment, the first clamp member and second clamp member configured to pivot independently of each other;

a socket member attached to the base member;

a support pillar having a first end and a second end, the first end having a ball member configured to be received within the socket member; and a leg support member attached to the second end of the support pillar.

18. The apparatus of claim 17 further comprising a shuttle member translation mechanism which translates the shuttle member along a surface of the base member from a first position to a second position, the second clamp member configured to move towards the first clamp member when the shuttle member is translated to the first position and the second clamp member configured to move away from the first clamp member when the shuttle member is translated to the second position.

19. The apparatus of claim 17 wherein the socket member comprises threads configured to receive a retaining cup, wherein the tightening of the retaining cup upon the threads of the socket member restrains a pillar ball end of the support pillar from movement.

20. The apparatus of claim 17 wherein the support pillar comprises a hollow upper pillar member, the upper collar member comprising a lower end comprising external threads, a collar member having a top end having internal threads configured to engage the external threads of the lower end, the collar member further comprising a bottom end, wherein the collar member comprises an opening extending from the top end to the bottom end, and a lower pillar member comprising a shaft having an upper end configured to be received within the collar member, the lower pillar member comprising the second end of the support pillar, the support pillar further comprising a fastening mechanism which retains the upper end of the shaft within the collar member.

* * * * *